US006260663B1

(12) United States Patent
Combs

(10) Patent No.: US 6,260,663 B1
(45) Date of Patent: Jul. 17, 2001

(54) PAINT CAN HOLDER FOR USE WITH LADDER HAVING TUBULAR RUNGS

(76) Inventor: Alan D. Combs, 926 E. Arnold, Herington, KS (US) 67449

( * ) Notice: Subject to any disclaimer, the term of this patent is extended or adjusted under 35 U.S.C. 154(b) by 0 days.

(21) Appl. No.: 09/127,350

(22) Filed: Jul. 31, 1998

(51) Int. Cl.[7] ..... E06C 7/00
(52) U.S. Cl. ..... 182/129; 248/210
(58) Field of Search ..... 182/129; 248/210, 248/238, 311.2, 310; D25/68; D7/691

(56) References Cited

U.S. PATENT DOCUMENTS

| | | | | |
|---|---|---|---|---|
| D. 272,552 | * | 2/1984 | Clanton . | |
| D. 324,272 | * | 2/1992 | Thiel | D25/68 |
| D. 356,165 | * | 3/1995 | Cassidy | D25/68 |
| D. 396,011 | * | 7/1998 | Henriksson | D7/691 |
| 3,913,878 | * | 10/1975 | Wayne | 248/311.2 |
| 4,702,446 | | 10/1987 | Brown | 248/210 |
| 4,776,550 | | 10/1988 | Storey | 248/210 |
| 4,979,710 | | 12/1990 | Baldwin | 248/210 |
| 5,106,045 | | 4/1992 | Bezotte | 248/210 |
| 5,145,226 | | 9/1992 | La Fontaine | 294/27.1 |
| 5,217,193 | * | 6/1993 | Drucker | 248/311.2 |
| 5,259,525 | | 11/1993 | Wion | 220/737 |
| 5,293,957 | | 3/1994 | Lundon, Jr. | 182/129 |
| 5,316,251 | | 5/1994 | Mc Graw | 248/210 |
| 5,649,682 | | 7/1997 | Martin | 248/210 |
| 5,687,941 | | 11/1997 | Quintile | 248/210 |
| 5,865,412 | * | 2/1999 | Mason | 248/311.2 |
| 5,934,632 | * | 8/1999 | Weaver | 248/210 |
| 5,971,103 | * | 10/1999 | Mulvaney | 248/238 |

* cited by examiner

*Primary Examiner*—Alvin Chin-Shue
(74) *Attorney, Agent, or Firm*—Kenneth W. Iles

(57) ABSTRACT

A bucket portion is connected to a handle portion in a unitary molded apparatus. The bucket portion holds a one-gallon (4 liter) paint can and includes a bottom well that includes a central circular recessed well portion to accept and retain a 1 quart (1 liter) paint can. Reinforcing ribs connect the small can well to the perimeter of the bottom wall. The upstanding side wall is tapered to be larger at the top than at the bottom. The arm is attached to the bucket with an enlarged reinforcing flared portion, which has a lower lip on the interior of the bucket portion, allowing a recessed rib portion of one unit to nest neatly within an adjacent unit for storage or shipping. The arm portion is inserted into the hollow rung of a ladder and retains the paint can in a convenient working position.

2 Claims, 3 Drawing Sheets

10
12
18
20
22
24
26
28
30
31
32
34
36
37
38
39
40
44
46
48
50
52
54
56
58
60
64
66
68

PAINT CAN HOLDER FOR USE WITH LADDER HAVING TUBULAR RUNGS

BACKGROUND OF THE INVENTION

1. Field of the Invention

The present invention is related to an apparatus for holding a paint can on a ladder. More particularly, the present invention is directed to an apparatus having an elongated handle connected to a bucket holder.

2. Description of Related Art Including Information Disclosed Under 37 C.F.R. Sections 1.97–1.99

Interior and exterior painting often requires the use of a ladder. Holding paint and painting tools while working on a ladder has always been a problem.

One solution is to provide a shelf on a step ladder. Step ladders, however, cannot be used in many situations because their A-frame construction often requires more space than is available and they are usefull only for relatively low heights.

Efforts to provide convenient storage of paint and paint tools with a rung-type ladder have included the simple expedient of hanging a pail can from the bale by a hook or wire that is suspended from a ladder rung. This allows the paint can to sway easily in response to wind or simply the force of wiping the brush against the inside rim of the paint can to remove excess paint. The paint can hangs behind the ladder, making access to it awkward.

Another approach is disclosed in U.S. Pat. No. 5,293,957, issued to Lunden, Jr. on Mar. 15, 1994, which discloses a rod bent into a circle and having a wire loop handle attached. The wire loop handle is slipped into the hollow rung of a tubular ladder rung. This device requires that a tapered paint bucket be used, requiring the transfer of paint from a paint can to the tapered bucket. Lunden, Jr. '957 also holds the paint can at a decided downward tilt. Finally, the elasticity of the wire handle allows the paint can to sway up and down in response to various forces, including the weight of the paint in the tapered pail.

U.S. Pat. No. 5,316,25, issued to McGraw on May 31, 1994 discloses a bar threaded on both ends that is passed through a tubular rung and includes a hoop bracket screwed onto both end of the bar. A paint can is set into each hoop. This device is supposed to be self-leveling, that is, the painter must use equal amounts of paint from each can at about the same rate to keep the cans horizontal. This device is very awkward to set up. It requires the painter either to paint with two hands, which few painters care to do, or to reach across his body to reach the paint can on his off-hand side. This is awkward, uncomfortable and can be dangerous, as the painter must lean his body backward away from the ladder in order to pass his painting hand and the brush between his body and the ladder.

U.S. Pat. No. 5,469,682, issued to Martin on Jul. 22, 1997, discloses a band that encircles a paint can and extends outwardly to form a handle that is slipped into a hollow ladder rung. This design requires the painter to tighten a wing nut to retain the can within the band. This device cannot hold the paint can horizontally and requires extra effort to secure the paint can. Further the device can be used only with one size of paint can. Further, none of these devices allows for storage of any tools, such as scrappers, paint brushes, rags, screwdrivers and so forth.

Therefore, there is a need for a paint can holder for use with a ladder having tubular rungs that holds a paint can steady in a more or less vertical orientation; that can be used with different sizes of standard paint cans; and that can hold a variety of small tools.

SUMMARY OF THE INVENTION

Accordingly, it is a primary object of the present invention to provide a paint can holder for use with a ladder having tubular rungs that holds a paint can steady in a more or less vertical orientation.

It is another object of the present invention to provide a paint can holder for use with a ladder having tubular rungs that can be used with different sizes of standard paint cans.

It is another object of the present invention to provide a paint can holder for use with a ladder having tubular rungs that can hold a variety of small tools.

These an other objects of the present invention are achieved by providing a one-piece apparatus having a paint can holder portion attached to a handle portion. The Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE PREFERRED EMBODIMENTS

Figure 1:
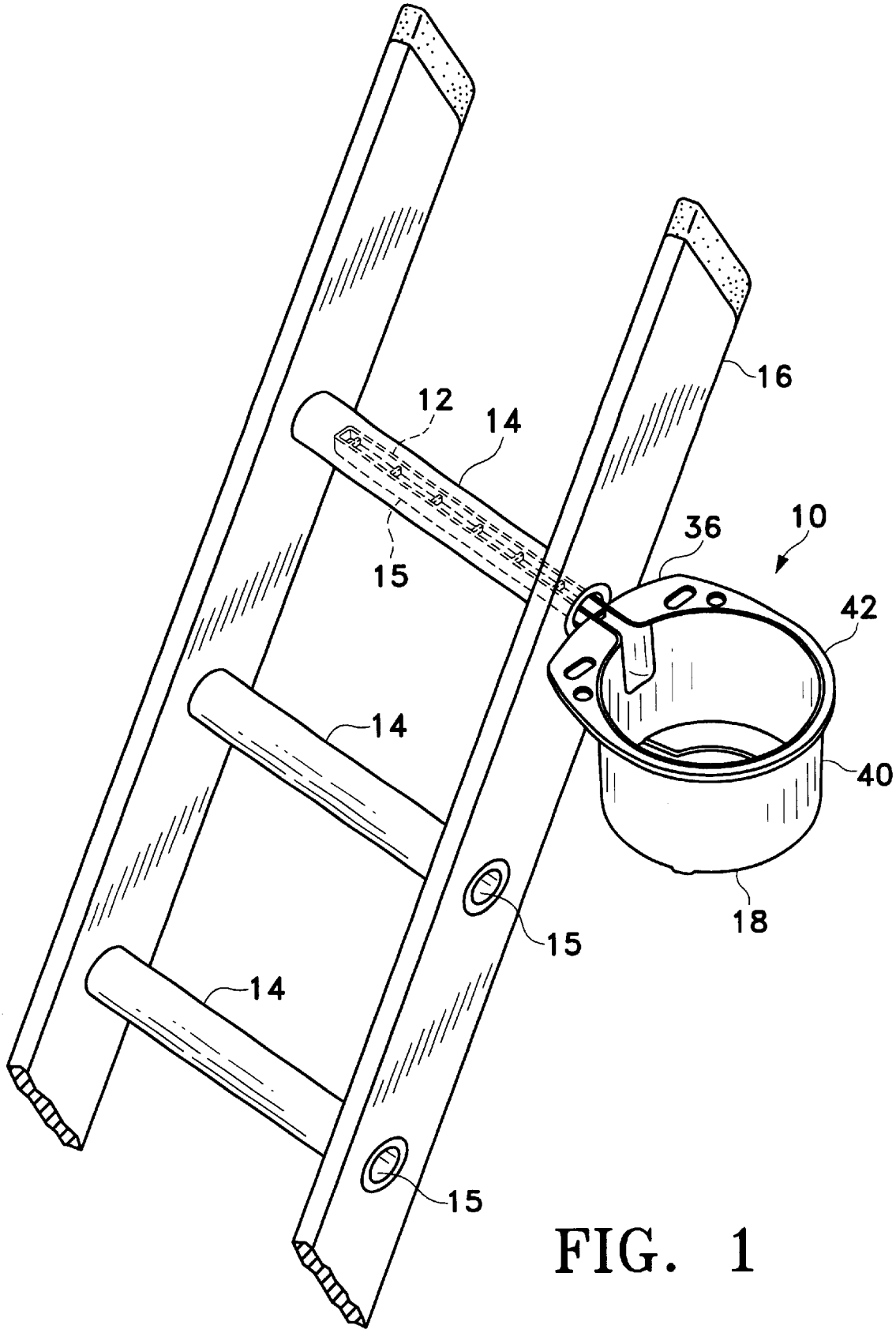
FIG. 1 is a perspective environmental view showing a paint can holder according to the present invention in use in a ladder.

Referring to FIG. 1, a paint can holder for use with a ladder having tubular rungs, or paint can holder, 10 includes an arm 12 that is inserted into the tubular rung 14 of a ladder 16 and a bucket portion 18 connected to the arm 12. A conventional one gallon (4 liter) paint can or a conventional 1 quart (1 liter) paint can be inserted into the bucket portion 18 and held in a stable manner, as explained in more detail below. The bucket portion 18 is retained in a vertical position by the downward pull of gravity on the paint and paint can, and by frictional engagement between the arm 12 in the interior walls 15 of the tubular rung 14. The arm 12 can be inserted into any desired tubular rung 14.

Referring to FIGS. 2–5, the arm 12 is preferably an elongated member having a bottom arm wall 20, a left-hand side arm wall 22, and a right-hand side arm wall 24, all more or less straight with the side walls perpendicular to the bottom arm wall 20. The top side 26 of the arm 12 is open, providing an open longitudinal arm channel, 28 that is open and includes six upright spaced parallel reinforcing bulkheads 30 that extend from the bottom arm wall 20 to a point below but adjacent to the upper edges 31 of the side walls 22, 24. This design reduces the weight and amount of materials used in the arm 12, while providing necessary strength. Adjacent to a distal end wall 32 of the arm 12 lies a storage or mounting aperture 34, for hanging the paint can holder 10 on a hook or nail for easy storage when not in use.

The arm 12 is joined to the bucket portion 18 at an upper flange portion 36 of the bucket 18 and at a flared reinforcing handle portion 38, both of which the arm 12 flows into. The flared reinforcing handle portion 38 of the arm 12 is both wider and longer than the arm 12 proper, providing increased strength where the arm 12 joints the body of the bucket portion 18.

Figure 6:
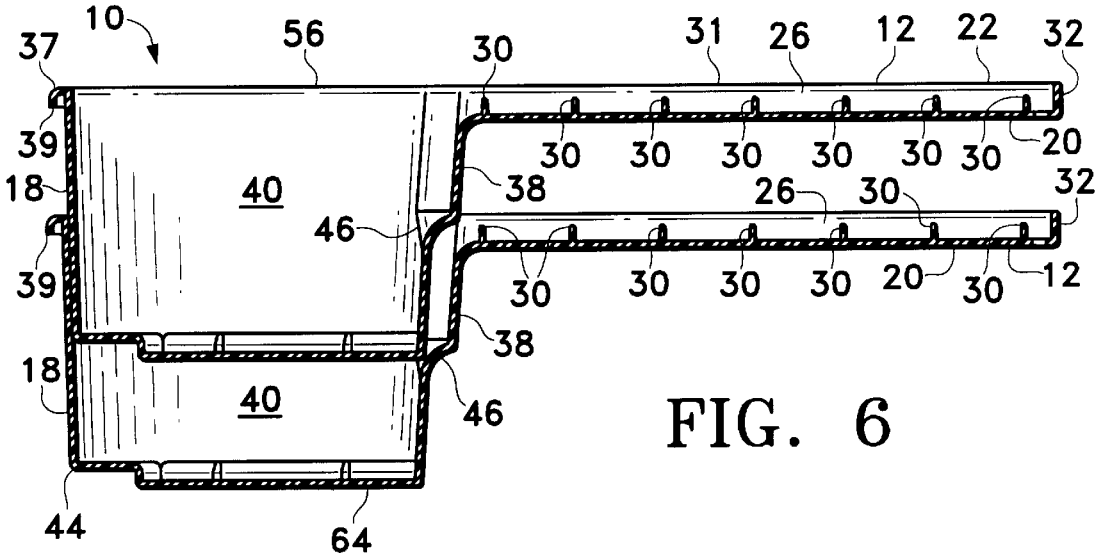
FIG. 6 is a cross sectional side elevation similar to FIG. 5 showing two nested paint can holders of FIG. 1.

The bucket portion 18 includes an upstanding tapered side wall, or bucket side wall, 40, which has a slight taper, growing wider at the top edge 42 than the bottom edge 44, allowing two or more paint can holders 10 to be stacked one inside the other, with the lower lip 46 of the flared reinforcing portion 38 of the arm 12 serving as a stop to prevent adjacent paint can holders 10 from being jammed tightly into one another, as shown in FIG. 6. The upper flange portion 36 of the bucket portion 18 is relatively thin portion that flares outwardly of the top edge 42 of the bucket portion 18 toward the arm 12 and includes a right-hand side flange portion 48 and a left-hand side flange portion 50, each including a circular tool storage aperture 52 and a slotted tool storage aperture 54. The upper flange portion 36 also includes a narrower substantially circumferential flange or rim 37. The entire upper flange portion 36, that is, about the entire perimeter of the bucket portion 18, includes a short depending skirt portion 39, which is coextensive with the flange or rim 37 and which further reinforces the structure. The entire upper flange portion 36 strengthens the bucket portion 18 and the connection between the bucket portion 18 and the arm 12.

The top 56 of the bucket portion 18 is open to accommodate the paint cans. A bucket bottom wall 58 has a perimeter that joins the bottom edge 44 of the tapered bucket side wall 40 to retain a paint can. The bucket bottom wall 58 includes a recessed central circular portion, or quart-can well, 60 adapted to receive and retain a one quart (one liter) paint can in a stable manner through frictional engagement of the lower portions of the side wall of the paint can and the circular portions side walls 62 of the recessed circular portion 60 of the bucket bottom wall 58. The one quart well 60 flows into three radiating triangular reinforcing ribs, each of which is symmetrical about a bisecting center line of each rib. The center line of each triangular reinforcing rib 62 is 102° of arc apart from one another. Each rib 62 includes recessed rib side walls 66, which are the same depth as the depth of the quart-can well 60. Each rib 62 radiates outwardly to the outer perimeter 68 of the bucket bottom wall 58. The depth of the quart-can well 60 and the recessed ribs is the same throughout the full extend of both portions. The lower surface of a rib 66 contacts the flared reinforcing portion 38 of the arm 12 when multiple units are nested (FIG. 6).

Figures 2, 3, 7:
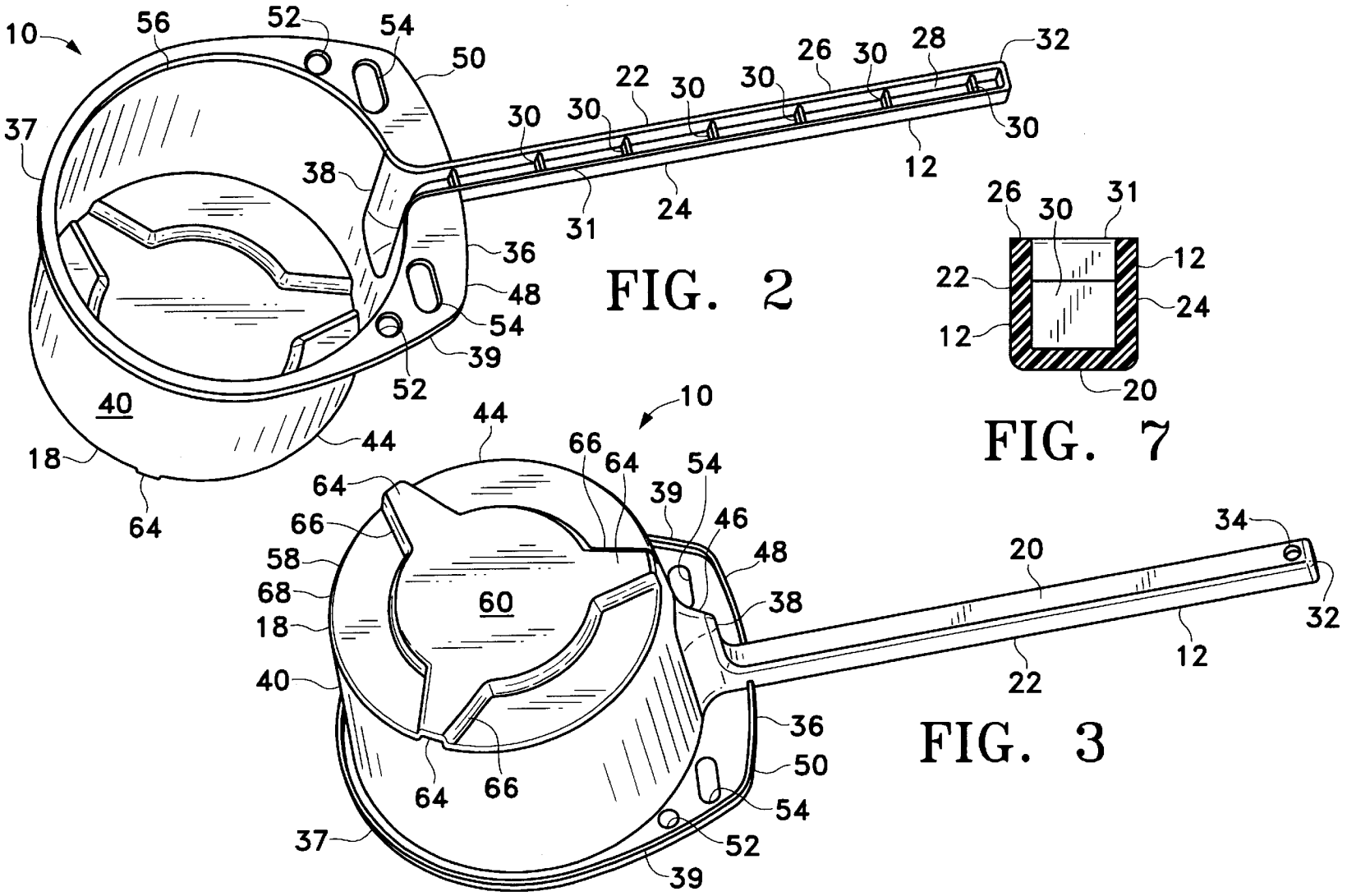
FIG. 2 is a top perspective view of the paint can holder of FIG. 1.
FIG. 3 is a bottom perspective view of the paint can holder of FIG. 1.
FIG. 7 is a cross sectional elevation taken along lines 7—7 of FIG. 4.
Figure 4:
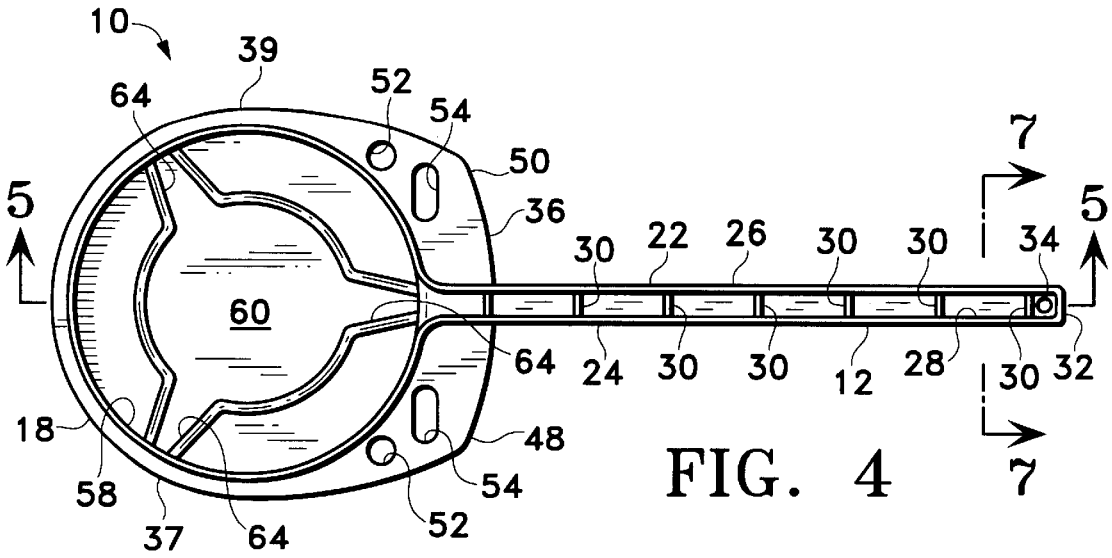
FIG. 4 is a top plan view of the paint can holder of FIG. 1.
Figure 5:
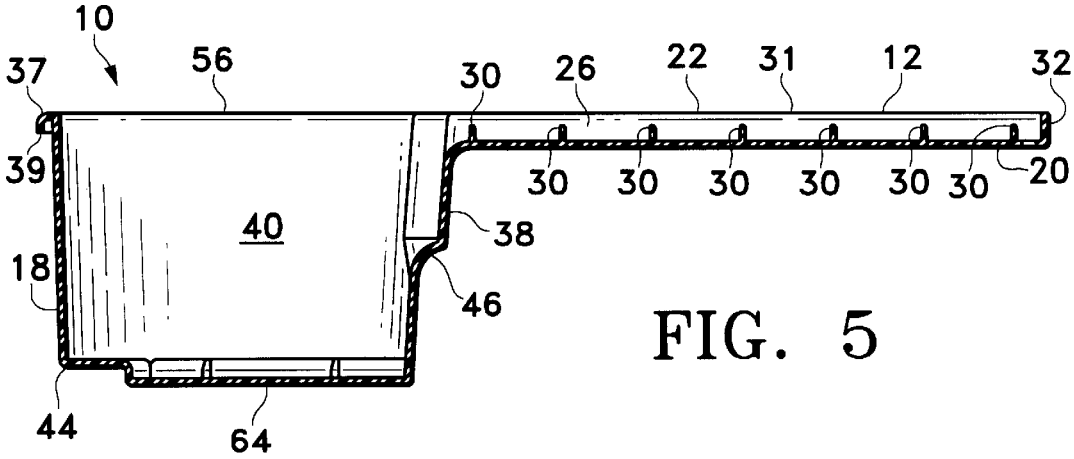
FIG. 5 is a cross sectional side elevation of the paint can holder of FIG. 1 taken along lines 5—5 of FIG. 4.

The entire paint can holder 10 is preferably made of a single piece of molded plastic material, such as polyvinyl chloride or glass filled nylon. The arm 20 will not break with either material, but more deflection occurs with the polyvinyl chloride material, unless the fit between the arm 12 and ladder rung 14 is quite tight. This may not be feasible in a commercial embodiment because tubular ladder rungs vary considerably in size between manufacturers, with a range of 1.9–2.4 cm common (FIGS. 7–8). Therefore, the preferred material is glass filled nylon. To reduce bucket deflection, which should be 0.25 inches (0.635 cm) or less from a straight line along the top of the arm 12, the arm 12 should be inserted as far as possible into the tubular ladder rung 14. Overhang is the distance the bucket portion 18 is removed from the outer surface of the rail 70 of the ladder 16. That is, the distance the arm 12 projects beyond the end of the ladder rung 14. The wider the tubular rung 14, the greater the deflection is. Further, the wider the ladder rungs are, the greater the deflection.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

I claim:

1. A paint can holder for use with a ladder having tubular rungs comprising a bucket having a circular bottom wall connected to an upright side wall having a circular top edge of greater diameter than said circular bottom wall and an arm extending horizontally from said bucket connected adjacent to said top edge with said arm further comprising a flared portion where said arm joints said bucket, said flared portion extending downwardly from said top edge to a point intermediate of said top edge and said bottom wall, forming an upper flared portion lip and a lower flared portion lip such that a bottom wall of a second similar paint can holder can rest upon said lower flared portion lip and the lower flared portion lip of said second paint can holder can rest upon said upper flared portion lip of said first paint can holder when two or more said paint can holder are stacked together, wherein said bottom wall comprises a recessed well portion having a recessed well bottom wall having a lower surface and a plurality of triangular ribs between said recessed well portion and an outer edge of said bottom wall, said triangular ribs having a lower surface lying in the same plane as said well bottom wall lower surface and an upper surface lying in the same plane as an upper surface of said bottom wall of said bucket, one of said triangular rib being vertically aligned with said upper flared portion lip and said lower flared portion lip to allow said second paint can holder to rest on the flared portion lips of said paint can holder when stacked together.

2. A paint can holder in accordance with claim 1 wherein said ribs are wider adjacent to said circular recessed well portion than at said outer edge of said bottom wall and taper uniformly from said circular recessed well portion of said bottom wall of said bucket to said outer edge.

* * * * *